United States Patent [19]

Fletcher

[11] 4,430,308

[45] Feb. 7, 1984

[54] HEATED ION EXCHANGE PROCESS FOR THE RECOVERY OF URANIUM

[75] Inventor: Argell Fletcher, Dallas, Tex.

[73] Assignee: Mobil Oil Corporation, New York, N.Y.

[21] Appl. No.: 449,125

[22] Filed: Dec. 13, 1982

[51] Int. Cl.[3] ..... C01G 43/00; C22B 60/02

[52] U.S. Cl. ..... 423/7; 423/6

[58] Field of Search ..... 423/7, 6; 210/660, 661, 210/681

[56] References Cited

U.S. PATENT DOCUMENTS 3,542,525 11/1970 Pigford et al. ..... 210/681 X

FOREIGN PATENT DOCUMENTS 138226 1/1959 U.S.S.R. ..... 210/681

OTHER PUBLICATIONS

Osborn, G. H., *Synthetic Ion-Exchangers,* Chapman and Hall Ltd., London, 1961, p. 45-46.

Nachod, F. C., Ed., *Ion Exchange Theory and Application,* Academic Press, New York, NY, 1949, p. 201-204.

Kunin, Robert, *Ion Exchange Resins,* Robert E. Krieger Pblshg. Co., Huntington, NY, 1972, p. 52, 69-71.

Dow Chemical, T. D. Index 100.01, 1971.

Merritt, Robert C. *The Extractive Metallurgy of Uranium* Colorado School of Mines Research Institute, 1971, pp. 138-156, 163, 164.

*Primary Examiner*—Benjamin R. Padgett

*Assistant Examiner*—Matthew A. Thexton

*Attorney, Agent, or Firm*—A. J. McKillop; M. G. Gilman; J. K. AboKhair

[57] ABSTRACT

The present invention relates to an improved method for the recovery of uranium values from a uranium-containing lixiviant by passing the lixiviant through a heated ion exchange resin to cause the resin to retain uranium values. The uranium values are subsequently recovered from the ion-exchange resin.

20 Claims, No Drawings

HEATED ION EXCHANGE PROCESS FOR THE RECOVERY OF URANIUM

FIELD OF THE INVENTION

This invention relates to the production of uranium and more particularly to the recovery of uranium from lixiviants by ion exchange adsorption.

BACKGROUND OF THE INVENTION

Uranium is produced from uranium-bearing ores by various procedures which employ a carbonate or acid lixiviant to leach the uranium from its accompanying gang material. The acid lixiviants usually are formulated with sulfuric acid which solubilizes uranium as complex uranyl sulfate anions. The sulfuric acid normally is used in a concentration to maintain a pH between about 0.5 to 2.0. However mild acidic solutions such as carbonic acid solutions, having a pH between about 5.0 and 7.0 may also be employed. Carbonate lixiviants contain carbonates, bicarbonates or mixtures thereof which function to complex the uranium in the form of water-soluble uranyl carbonate ions. The carbonate lixiviants may be formulated by the addition of alkali metal carbonates and/or bicarbonates or by the addition of carbon dioxide either alone or with an alkaline agent such as ammonia or sodium hydroxide in order to control the pH. The pH of the carbonate lixiviants may range from about 5 to 10. The carbonate lixiviants may also contain a sulfate leaching agent. The lixiviant also contains a suitable oxidizing agent such as oxygen or hydrogen peroxide.

The leaching operation may be carried out in conjunction with surface milling operations wherein uranium ore obtained by mining is crushed and blended prior to leaching, heap leaching of ore piles at the surface of the earth, or in situ leaching wherein the lixiviant is introduced into a subterranean ore deposit and then withdrawn to the surface. Regardless of the leaching operation employed, the pregnant lixiviant is then treated in order to recover the uranium therefrom. One conventional uranium recovery process involves passing the pregnant lixiviant through an anionic exchange resin and the elution of the resin with a suitable eluant to desorb the uranium from the resin. The resulting concentrated eluate is then treated to recover the uranium values, for example, by precipitating uranium therefrom to produce the familiar "yellowcake."

The anionic ion exchange resins employed for uranium concentration are characterized by fixed cationic adsorption sites in which the mobile anion, typically chloride or another halide, hydroxide, carbonate or bicarbonate, is exchanged by the uranyl complex anion. Such anionic ion exchange resins are disclosed, for example, in Merritt, R.C., THE EXTRACTIVE METALLURGY OF URANIUM, Colorado School of Mines Research Institute, 1971, pages 138–147, which are hereby incorporated by reference. Suitable anionic exchange resins may take the form of polymers or copolymers of styrene substituted with quaternary ammonium groups or polymers or copolymers of pyridine which are quaternized to form pyridinium groups.

The adsorption of uranium from aqueous solutions is described by Merritt at pages 147–156, which are hereby incorporated by reference, where it is recognized that the presence of molybdenum in the pregnant lixiviant tends to reduce adsorption of uranium by the anionic ion exchange resin. Merritt discloses at pages 154, 163, and 164 that the presence of molybdenum in the pregnant lixiviant tends to poison the ion exchange resin, thus reducing the adsorption of uranium by the resin which results in decreased resin loading.

SUMMARY OF THE INVENTION

The present invention provides an improved process for the selective recovery of uranium values from a pregnant lixiviant additionally containing molybdenum values as the primary contaminants, using heated ion exchange resin. In accordance with the present invention, the pregnant lixiviant is passed through heated ion exchange resin wherein the resin is heated to a temperature sufficient to substantially increase the uranium loading capacity of the resin but without an increase in the molybdenum interference with uranium loading. The resin is preferably maintained at a temperature not less than 110° F. and most preferably maintained at a temperature range of about 130° F. to 150° F. The uranium values loaded on the resin are then eluted from the resin with a suitable eluate such as a chloride solution which may contain carbonates and/or bicarbonates. The pregnant eluate may then be subjected to processes for the precipitation of uranium values, for example, in the form of yellowcake.

The present invention may be applied in the process where uranium-containing ore is leached, either by surface operations or utilizing in situ leaching operations, to recover uranium values therefrom. The present invention is particularly suitable in uranium-leaching processes wherein heated leaching solutions are utilized to solubilize and recover uranium values from uranium-containing ore.

DESCRIPTION OF SPECIFIC EMBODIMENTS

As noted previously, the recovery of uranium from pregnant lixiviant involves concentration of the uranium employing an ion exchange resin and subsequent precipitation to recover the uranium as yellowcake. The pregnant lixiviant is passed through one or more ion exchange columns operated in accordance with any suitable procedure. Such procedures are well known in the art and are described in Merritt, R.C., the Extractive Metallurgy of Uranium, Colorado School of Mines Research Institute (1971) at page 167 et Seq. under the heading "Ion Exchange Processes and Equipment." For example, the ion exchange column may be operated in a "fixed bed" mode or "moving bed" mode as described in Merritt. However, in accordance with the present invention, the ion exchange process is modified to allow the maintenance of the ion exchange resin at elevated temperatures.

The anionic ion exchange resins most commonly employed in uranium recovery operations are the so-called "Type I" resins in which the adsorption sites are provided by quaternary ammonium groups in which all of the quaternizing substituents are alkyl groups, normally methyl groups. The Type I resins may be prepared by chloromethylation of the base polyaryl polymer and subsequent reaction with a tertiary amine such as trimethylamine. The so-called "Type II" resins may also be used in uranium recovery and are particularly useful in the concentration of uranium from lixiviants containing chloride ions which inhibit the adsorption of uranyl ions. The Type II resins are characterized by cationic adsorption sites provided by quaternary ammonium groups having a hydroxy alkyl group as a quaternizing substituent. Typically the cationic adsorption sites for Type II resins take the form of methylene hydroxyalkyldimethylammonium groups in which the hydroxyalkyl group contains one or two carbon atoms. The Type II resins may be prepared by reaction of the chloromethylated base polymer with a tertiary amine such as dimethylethanolamine or dimethylmethanolamine. For a further description of Type I and Type II resins, reference is made to Dowex: Ion Exchange, the Dow Chemical Co., Midland, Mich. (1958, 1959), and specifically the section entitled "Strong Base Resins" found in pages 4 and 5. As indicated there, a commercially available Type II resin is Dowex 2 in which the cationic adsorption sites are provided by methylene hydroxyethyldimethylammonium groups. Other commercially available Type II ion exchange resins include Duolite 102D available from the Diamond Shamrock Chemical Company, Ionac A-550 and Ionac A-651 available from Ionac Chemical Company, and IRA 410 and IRA 910 available from the Rohm & Haas Company. In each of these resins, the resin network is formed of copolymers of styrene and divinylbenzene having various degrees of crosslinking and the cationic functional groups are provided by methylene hydroxyethyldimethylammonium groups, similarly as in the case of Dowex 2.

In experimental work relative to the present invention, column adsorption tests were carried out employing two commercially available ion exchange resins, IRA 430 and Dowex 21-K. In each of these resins, the cationic adsorption sites are provided by methylene trimethylammonium groups. The IRA 430 and Dowex 21-K have a gel type physical structure.

Thus, in accordance with the present invention, uranium values are recovered from a uranium-containing lixiviant by passing the lixiviant through a heated ion exchange resin to cause the resin to retain uranium values. The resin is heated to a temperature to cause a substantial increase in the uranium-loading capacity of the resin as compared to ambient conditions. It is preferred that the resin be heated to a temperature of at least 110° F. while it is most preferred to heat the resin to a temperature of about 130° to about 150° F. Additionally the lixiviant itself may be heated, to a temperature substantially equivalent to that of the resin, prior to passing through the resin.

When molybdenum is additionally present in the lixiviant, the heated ion exchange resin may initially retain some molybdenum values, but the molybdenum values are later displaced by uranium values. Thus, heating the resin in accordance with the present invention not only allows the selective recovery of uranium but also substantially increases the uranium-loading capacity of the resin. Additionally, the heated resin shows very low uranium leakage during loading. For example, the heated resins allow 70 to 80% loading before uranium breakthrough. This is highly advantageous in that it allows the disposal of a substantial amount of the eluant without the necessity of recycling, further uranium-removal, or uranium/molybdenum separation processes.

After the uranium values are loaded on the heated resin, then the resin is eluted to recover the uranium values. A suitable eluant is an aqueous solution of chloride ions which may additionally contain carbonates and/or bicarbonates. The elution may also be performed at elevated temperatures.

EXPERIMENTAL

As stated above, Dowex 21K and IRA 430 were the resins utilized in experimental work relative to the present invention. To carry out the experiments, resin columns were constructed from glass by sealing a smaller diameter glass tube inside of a larger tube with side arms so water could be circulated around the inner tube. The inner tube was filled with the appropriate resin while the outer tube was connected to a constant temperature water bath.

Two synthetic lixiviant solutions were prepared. One lixiviant solution (solution A) contained 1.377 grams per liter of sodium bicarbonate and 165 ppm $U_3O_8$. Solution A had a pH of about 7.47. The second lixiviant solution (solution B) contained 1.377 grams per liter of sodium bicarbonate, 165 ppm $U_3O_8$, and 18.2 ppm molybdenum. Solution B had a pH of about 7.37.

Four resin columns were prepared, two utilizing Dowex 21K resin and two utilizing IRA 430 resin. The columns were connected to the water bath which was adjusted to a temperature of 140° F. Once the columns were equilibrated to such temperature, they were flushed with approximately 28 bed volumes (BV) of 1 M NaCl solution additionally containing 5 g/l $Na_2CO_3$ and 5 g/l $NaHCO_3$. The excess NaCl was removed with 28 bed volumes of distilled water. The columns were subsequently loaded by flowing solution A (no molybdenum) through one column each of Dowex 21K and IRA 430 at an average flow rate of 0.13 BV/minute. The other two columns were loaded with solution B (molybdenum added). Periodic samples were taken from the effluent of each column and analyzed for uranium and/or molybdenum. Uranium loading was continued until a 91% to 99% leakage was obtained. Each column was then eluted with a fresh eluant solution of 1 M NaCl, 5 g/l $Na_2CO_3$ and 5 g/l $NaHCO_3$. The experiments as described above were repeated at room temperature (about 77° F.). Table 1 shows the resin and column characteristics.

TABLE 1

RESIN AND COLUMN CHARACTERISTICS

| Column | Resin Type | Resin Wet Wt. grams | Length CM | Diameter CM | Flow Rate BV/Min | Bed Volume |
|---|---|---|---|---|---|---|
| 1 | Dowex 21K | 1.791 | 15.5 | .48 | .12 | 2.3 |
| 2 | Dowex 21K | 1.805 | 15.7 | .48 | .124 | 2.32 |
| 3 | IRA 430 | 1.576 | 15.5 | .48 | .109 | 2.55 |
| 4 | IRA 430 | 1.051 | 10.5 | .48 | .168 | 1.75 |

Tables II and III show the data obtained while loading and eluting hot pregnant lixiviant (solution A) using Dowex 21K resin. This data shows leakage was extremely low until the resin was about 78% loaded, at which time the leakage increased sharply. The final loading capacity at 91% leakage was 11.0 lbs $U_3O_8$ per cubic foot of resin.

TABLE II $U_3O_8$ Loading on Dowex 2lK Resin (Col. 2)
Hot Lixiviant (140° F.) Without Molybdenum

| Volume ML | BV | Effluent $U_3O_8$ Conc., Mg/liter | On Column $U_3O_8$ Mg/ML Resin |
|---|---|---|---|
| 26.9 | 11.6 | 0.000 | 1.75 |
| 56.1 | 35.8 | 0.000 | 5.40 |
| 169.0 | 108.6 | 0.000 | 16.40 |
| 128.8 | 164.1 | 0.000 | 24.79 |
| 183.6 | 243.2 | 0.000 | 36.74 |
| 132.0 | 300.1 | 0.000 | 45.33 |
| 279.9 | 420.8 | 0.024 | 63.55 |
| 272.6 | 538.3 | 0.060 | 81.29 |
| 176.0 | 614.2 | 0.208 | 92.73 |
| 265.8 | 728.8 | 1.100 | 110.50 |
| 138.1 | 788.3 | 2.580 | 119.65 |
| 242.8 | 893.0 | 6.070 | 135.37 |
| 198.0 | 978.4 | 11.420 | 147.73 |
| 213.8 | 1070.6 | 20.640 | 160.23 |
| 262.3 | 1184.6 | 85.260 | 168.32 |
| 287.8 | 1308.7 | 125.000 | 172.27 |
| 144.1 | 1370.8 | 142.680 | 173.15 |

TABLE III $U_3O_8$ Elution From Dowex 21K Resin (Col. 2)

| Volume ML | BV | Effluent $U_3O_8$ Conc., gm/liter | Cumm. $U_3O_8$ Mg |
|---|---|---|---|
| 0.4 | 0.2 | 0.149 | 0.0596 |
| 1.0 | 0.6 | 20.636 | 20.70 |
| 1.5 | 1.3 | 25.707 | 59.26 |
| 2.4 | 2.3 | 22.287 | 112.74 |
| 4.4 | 4.2 | 15.959 | 182.96 |
| 10.0 | 8.5 | 10.507 | 288.03 |
| 17.0 | 15.8 | 5.401 | 379.84 |
| 138.0 | 75.3 | 0.249 | 414.26 |
| 13.5 | 81.1 | 0.006 | 414.27 |

Tables IV and V show the data obtained while loading and eluting column 1 (Dowex 21K) with hot pregnant lixiviant which contained 18.2 ppm molybdenum (solution B). The data shows very low uranium leakage up to 80% loading capacity. The final loading was 10.8 lbs $U_3O_8$ per cubic foot of resin for a 99% leakage. In comparing this with the data in tables II and III, it can be seen that the molybdenum does not significantly affect the uranium loading capacity of the resin.

Table IV also shows the simultaneous loading of molybdenum and uranium up to about 46% loading capacity. The final molybdenum saturation of the resin occurred just before uranium breakthrough. However, the molybdenum values were completely displaced before the resin was saturated with uranium. The molybdenum concentration in the effluent reached a value over three times that of the feed solution B.

TABLE IV $U_3O_8$ Loading of Dowex 2lK Resin (Col. 1)
Hot Lixiviant (140° F.) With Molybdenum

| Volume ML | BV | Effluent Mo Conc., Mg/liter | Effluent $U_3O_8$ Conc., Mg/liter | On Column $U_3O_8$ Mg/Ml Resin |
|---|---|---|---|---|
| 25.8 | 11.2 | .016 | 0.000 | 1.75 |
| 54.0 | 34.7 | — | 0.000 | 5.41 |
| 165.1 | 106.5 | 0.000 | 0.000 | 16.61 |
| 126.0 | 161.3 | 0.000 | 0.000 | 25.16 |
| 181.7 | 240.3 | 0.000 | 0.000 | 37.48 |
| 130.0 | 296.8 | 0.000 | 0.000 | 46.30 |
| 274.7 | 389.2 | .522 | .079 | 64.92 |
| 265.8 | 504.8 | 3.7 | .124 | 82.93 |

TABLE IV-continued $U_3O_8$ Loading of Dowex 2lK Resin (Col. 1)
Hot Lixiviant (140° F.) With Molybdenum

| Volume ML | BV | Effluent Mo Conc., Mg/liter | Effluent $U_3O_8$ Conc., Mg/liter | On Column $U_3O_8$ Mg/Ml Resin |
|---|---|---|---|---|
| 247.2 | 612.3 | 14.4 | .382 | 99.66 |
| 253.3 | 722.4 | 49.3 | 2.020 | 116.62 |
| 131.9 | 779.8 | 56.2 | 3.960 | 125.34 |
| 268.8 | 896.7 | 43.2 | 7.540 | 142.72 |
| 280.5 | 1018.7 | 35.6 | 21.460 | 159.16 |
| 265.1 | 1134.0 | 24.5 | 67.800 | 169.35 |
| 274.5 | 1253.4 | 48.6 | 105.420 | 176.05 |
| 139.0 | 1313.8 | 19.5 | 132.660 | 177.80 |
| 164.0 | 1385.1 | 21.0 | 169.220 | 178.56 |
| 134.1 | 1443.4 | 20.5 | 178.060 | 178.66 |

TABLE V $U_3O_8$ Elution From Dowex 2lK (Col. 1)

| Volume ML | BV | Effluent $U_3O_8$ Conc., gm/liter | Cumm. $U_3O_8$ Mg |
|---|---|---|---|
| 0.6 | 0.26 | 3.99 | 1.81 |
| 1.0 | 0.70 | 22.169 | 23.98 |
| 2.0 | 1.6 | 24.292 | 72.56 |
| 2.9 | 2.8 | 18.513 | 126.25 |
| 5.0 | 5.0 | 12.617 | 189.34 |
| 10.2 | 9.4 | 7.995 | 270.89 |
| 20.0 | 18.1 | 3.962 | 350.13 |
| 152.0 | 84.2 | 0.222 | 383.83 |
| 15.0 | 90.7 | .0002 | 383.83 |

Tables VI and VII show the data for the loading and elution of IRA 430 resin (column 4) with hot pregnant lixiviant without molybdenum (solution A). This resin also shows a very low leakage, up to 71% loading before uranium breakthrough. The final uranium loading at 99% leakage was 10.3 lbs $U_3O_8$ per cubic foot of resin.

TABLE VI $U_3O_8$ Loading on IRA 430 (Col. 4)
Hot Lixiviant (140° F.) Without Molybdenum

| Volume ML | BV | Effluent $U_3O_8$ Conc., Mg/liter | On Column $U_3O_8$ Mg/ML Resin |
|---|---|---|---|
| 29.2 | 16.7 | 0.00 | 2.52 |
| 57.6 | 49.6 | 0.00 | 7.49 |
| 174.1 | 149.1 | 0.00 | 22.51 |
| 131.3 | 224.1 | 0.00 | 33.84 |
| 189.3 | 332.2 | 0.00 | 50.17 |
| 135.1 | 409.4 | 0.00 | 61.83 |
| 268.8 | 563.0 | 2.05 | 84.71 |
| 259.9 | 711.5 | 7.38 | 106.04 |
| 243.2 | 850.5 | 29.48 | 122.93 |
| 250.3 | 993.5 | 73.70 | 134.74 |
| 130.7 | 1068.2 | 120.28 | 135.43 |
| 242.2 | 1206.6 | 106.13 | 142.37 |
| 255.9 | 1352.8 | 130.89 | 146.08 |
| 239.8 | 1489.8 | 132.07 | 149.39 |
| 250.5 | 1632.9 | 166.27 | 148.04 |
| 274.8 | 1789.9 | 145.04 | 149.93 |
| 138.2 | 1868.9 | 154.48 | 150.12 |

TABLE VII $U_3O_8$ Elution From IRA 430 (Col. 4)

| Volume ML | BV | Effluent $U_3O_8$ Conc., Mg/Liter | Cumm. $U_3O_8$ Mg |
|---|---|---|---|
| 0.5 | 0.3 | 8.078 | 4.039 |
| 1.0 | 0.9 | 15.919 | 19.96 |

TABLE VII-continued

| $U_3O_8$ Elution From IRA 430 (Col. 4) | | | |
|---|---|---|---|
| Volume ML | BV | Effluent $U_3O_8$ Conc., Mg/Liter | Cumm. $U_3O_8$ Mg |
| 1.7 | 1.8 | 21.933 | 57.24 |
| 2.5 | 3.3 | 16.669 | 98.96 |
| 4.3 | 5.7 | 10.754 | 145.20 |
| 10.0 | 11.4 | 6.427 | 209.47 |
| 17.0 | 21.1 | 3.378 | 266.90 |
| 132.0 | 96.6 | 0.361 | 314.53 |
| 13.0 | 104.0 | 0.0013 | 314.55 |

The data in tables VIII and IX show the loading and elution of IRA 430 resin (Col. 3) utilizing solution B as the pregnant lixiviant. The data shows that molybdenum does not affect uranium loading on the resin. The resin was 81% loaded before any significant uranium breakthrough. The final loading at 91% leakage was 10.9 lbs $U_3O_8$ per cubic foot of resin.

The molybdenum loading and displacement showed the same behavior as with the Dowex 21K resin. The molybdenum concentration in the effluent reached three times that in the feed solution B. Again, the molybdenum values were completely displaced before the resin was saturated with uranium.

TABLE VIII

| $U_3O_8$ Loading on IRA 430 (Col. 3) Hot Lixiviant (140° F.) With Molybdenum | | | | |
|---|---|---|---|---|
| Volume ML | BV | Effluent Mo Conc., Mg/liter | Effluent $U_3O_8$ Conc., Mg/liter | On Column $U_3O_8$ Mg/Ml Resin |
| 26.7 | 10.5 | 0.00 | 0.00 | 1.63 |
| 55.1 | 32.1 | 0.00 | 0.00 | 5.00 |
| 166.8 | 97.5 | 0.00 | 0.00 | 15.21 |
| 126.8 | 147.2 | 0.00 | 0.00 | 22.97 |
| 182.7 | 218.9 | 0.00 | 0.00 | 34.14 |
| 129.7 | 269.8 | 0.00 | 0.00 | 42.08 |
| 272.9 | 376.8 | 0.06 | 0.00 | 58.78 |
| 267.1 | 481.6 | 0.62 | 0.12 | 75.11 |
| 251.5 | 580.2 | 5.52 | 0.00 | 90.50 |
| 223.0 | 667.7 | 42.60 | .16 | 104.13 |
| 132.8 | 719.8 | 56.90 | .71 | 112.22 |
| 254.9 | 819.8 | 46.50 | 1.31 | 127.71 |
| 260.2 | 921.8 | 42.80 | 9.27 | 142.71 |
| 251.8 | 1020.6 | 25.60 | 53.42 | 152.86 |
| 260.0 | 1122.6 | 45.70 | 86.79 | 160.48 |
| 132.3 | 1174.5 | 19.70 | 114.38 | 162.93 |
| 157.9 | 1236.4 | 21.00 | 142.68 | 165.23 |
| 144.4 | 1293.0 | 20.10 | 163.91 | 166.13 |

TABLE IX

| $U_3O_8$ Elution From IRA 430 (Col. 3) | | | |
|---|---|---|---|
| Volume ML | BV | Effluent $U_3O_8$ Conc., gm/liter | Cumm. $U_3O_8$ Mg |
| 0.3 | 0.12 | 0.253 | 0.0759 |
| 1.0 | 0.51 | 18.396 | 18.47 |
| 1.7 | 1.2 | 26.768 | 63.98 |
| 2.6 | 2.2 | 23.348 | 124.68 |
| 4.5 | 4.0 | 15.683 | 195.26 |
| 10.4 | 8.0 | 9.339 | 292.39 |
| 17.0 | 14.7 | 4.894 | 375.58 |
| 136.0 | 68.0 | 0.677 | 467.63 |
| 13.5 | 73.3 | 0.007 | 467.64 |

A second set of tests were run using the same resins and pregnant lixiviant at ambient temperature which was around 77° F. Tables X and XI show the results for the Dowex 21K resin with pregnant lixiviant without molybdenum. Uranium breakthrough occurred at a loading of 58%. This was much sooner than the high temperature run under comparative conditions. The final loading at 99% leakage was 8.1 lbs $U_3O_8$ per cubic foot of resin. Thus it can be seen that heating the resin allowed for a 35.80% increase in the loading capacity of the resin.

TABLE X

| $U_3O_8$ Loading on Dowex 21K Resin (Col. 2) Room Temperature - Without Molybdenum | | | |
|---|---|---|---|
| Volume ML | BV | Effluent $U_3O_8$ Conc., Mg/liter | On Column $U_3O_8$ Mg/Ml Resin |
| 274.3 | 118.2 | 0.00 | 19.52 |
| 255.4 | 228.3 | 1.13 | 37.57 |
| 136.0 | 286.9 | 1.67 | 47.15 |
| 287.3 | 410.7 | 4.95 | 66.98 |
| 276.2 | 529.8 | 12.26 | 85.17 |
| 290.8 | 655.2 | 44.63 | 100.27 |
| 275.8 | 774.1 | 81.25 | 110.24 |
| 133.0 | 831.4 | 117.92 | 112.94 |
| 275.4 | 950.1 | 145.04 | 115.32 |
| 273.6 | 1068.03 | 156.83 | 116.29 |
| 279.0 | 118.3 | 162.70 | 116.57 |

TABLE XI

| Elution of $U_3O_8$ From Column 1 Room Temperature - Without Molybdenum | | | |
|---|---|---|---|
| Volume ML | BV | Effluent $U_3O_8$ Conc., gm/Liter | Cumm. $U_3O_8$ Mg |
| 1.2 | 0.52 | 0.167 | 0.20 |
| 0.7 | 0.82 | 5.020 | 3.72 |
| 1.1 | 1.30 | 34.610 | 41.79 |
| 2.2 | 2.20 | 30.900 | 109.76 |
| 5.0 | 4.40 | 12.150 | 170.49 |
| 11.0 | 9.10 | 6.070 | 237.29 |
| 20.3 | 17.90 | 2.130 | 280.49 |
| 29.8 | 30.70 | 0.980 | 309.66 |
| 97.0 | 72.50 | 0.220 | 330.48 |
| 6.1 | 75.20 | 0.002 | 330.49 |

Tables XII and XIII show the results of loading and eluting uranium from a Dowex 21K resin (column 1). This test was run at room temperature with a lixiviant containing molybdenum (solution B). Uranium breakthrough occurred at approximately 53% uranium saturation. The final uranium loading at a leakage of 99% was 7.9 lbs $U_3O_8$ per cubic foot of resin. In comparing this with the comparative test at elevated temperatures (140° F.), it can be seen that heating the resin resulted in a 36.71% increase in the loading capacity of the resin.

TABLE XII

| $U_3O_8$ Loading on Dowex 21K Resin (Col. 1) Room Temperature - With Molybdenum | | | | |
|---|---|---|---|---|
| Volume ML | BV | Effluent Mo Conc., Mg/liter | Effluent $U_3O_8$ Conc., Mg/liter | On Column $U_3O_8$ Mg/Ml Resin |
| 295.2 | 128.4 | 0.00 | 0.00 | 21.19 |
| 274.5 | 247.8 | 0.61 | 1.30 | 40.74 |
| 144.0 | 310.4 | 1.51 | 2.17 | 50.94 |
| 285.5 | 434.5 | 8.21 | 7.17 | 70.54 |
| 270.9 | 552.3 | 37.35 | 13.44 | 88.40 |
| 282.4 | 675.1 | 54.00 | 50.35 | 102.49 |
| 267.2 | 791.3 | 19.70 | 111.91 | 108.67 |
| 126.5 | 846.3 | 18.70 | 125.00 | 110.88 |
| 254.5 | 957.0 | 19.00 | 149.76 | 112.58 |
| 251.5 | 1066.4 | 18.60 | 155.65 | 113.61 |
| 255.9 | 1177.7 | 19.10 | 162.7 | 113.87 |

TABLE XIII

Elution of $U_3O_8$ From Column 1
Room Temperature - With Molybdenum

| Volume ML | BV | Effluent $U_3O_8$ Conc., gm/Liter | Cumm. $U_3O_8$ Mg |
|---|---|---|---|
| 1.0 | 0.44 | 0.182 | 0.182 |
| 0.8 | 0.76 | 0.719 | 0.757 |
| 1.1 | 1.26 | 26.710 | 30.137 |
| 2.1 | 2.10 | 32.250 | 97.864 |
| 5.0 | 4.40 | 12.970 | 162.720 |
| 10.9 | 9.10 | 6.010 | 228.270 |
| 20.0 | 17.80 | 2.130 | 270.840 |
| 29.4 | 30.60 | 0.973 | 299.440 |
| 94.0 | 71.40 | 0.193 | 317.620 |
| 5.9 | 74.00 | 0.007 | 317.660 |

Tables XIV and XV show the data for the loading and elution of IRA 430 resin at room temperature when loaded with pregnant lixiviant without molybdenum (solution A). At 99% leakage, the loading capacity was 7.0 lbs $U_3O_8$ per cubic foot of resin. The comparative example at 140° F. shows that heating the resin resulted in a 47.14% increase in the loading capacity of the resin.

TABLE XIV $U_3O_8$ Loading on IRA 430 (Col. 4)
Room Temperature - Without Molybdenum

| Volume ML | BV | Effluent $U_3O_8$ Conc., Mg/liter | On Column $U_3O_8$ Mg/Ml Resin |
|---|---|---|---|
| 265.8 | 151.9 | 0.159 | 25.05 |
| 246.2 | 292.6 | 1.430 | 48.08 |
| 130.0 | 376.5 | 3.310 | 60.10 |
| 290.7 | 542.6 | 32.900 | 82.06 |
| 277.1 | 700.9 | 112.020 | 90.46 |
| 290.7 | 867.1 | 147.990 | 93.30 |
| 274.7 | 1024.7 | 145.400 | 96.45 |
| 130.7 | 1099.4 | 146.220 | 97.86 |
| 268.0 | 1252.5 | 161.550 | 98.40 |
| 265.0 | 1403.9 | 164.300 | 98.52 |
| 269.4 | 1557.8 | 163.300 | 98.79 |

TABLE XV

Elution of $U_3O_8$ from Column 4
Room Temperature - Without Molybdenum

| Volume ML | BV | Effluent $U_3O_8$ Conc., gm/Liter | Cumm. $U_3O_8$ Mg |
|---|---|---|---|
| 1.00 | 0.57 | 0.188 | 0.188 |
| 0.45 | 0.83 | 4.920 | 2.40 |
| 0.85 | 1.30 | 27.480 | 25.75 |
| 1.72 | 2.30 | 25.350 | 69.36 |
| 4.50 | 4.90 | 9.160 | 110.59 |
| 9.30 | 10.21 | 4.610 | 153.47 |
| 17.60 | 20.20 | 1.630 | 182.11 |
| 26.00 | 35.10 | 0.720 | 200.81 |
| 84.00 | 83.10 | 0.241 | 221.02 |
| 5.10 | 86.00 | .002 | 221.03 |

Tables XVI and XVII show the data for loading and elution of IRA 430 resin at room temperature with a pregnant lixiviant containing 18.2 ppm molybdenum (solution B). After 96.4% leakage the uranium loading capacity was 7.4 lbs $U_3O_8$ per cubit foot of resin. Comparing this with the equivalent test at 140° F., it is shown that heating the resin resulted in a 47.30% increase in its uranium loading capacity.

TABLE XVI $U_3O_8$ Loadinq on IRA 430 Resin (Col. 3)
Room Temperature - With Molybdenum

| Volume ML | BV | Effluent Mo Conc., Mg/liter | Effluent $U_3O_8$ Conc., Mg/liter | On Column $U_3O_8$ Mg/Ml Resin |
|---|---|---|---|---|
| 287.0 | 112.6 | 0.00 | 0.000 | 18.58 |
| 265.8 | 216.8 | 0.06 | 0.028 | 35.79 |
| 140.0 | 271.7 | 0.25 | 0.186 | 44.84 |
| 278.0 | 380.7 | 2.30 | 0.948 | 64.52 |
| 264.5 | 484.4 | 21.40 | 4.550 | 81.17 |
| 275.0 | 592.2 | 64.00 | 27.240 | 96.04 |
| 262.0 | 695.0 | 30.95 | 93.160 | 103.43 |
| 122.0 | 742.8 | 24.00 | 119.100 | 105.63 |
| 249.4 | 840.6 | 18.70 | 147.400 | 107.36 |
| 251.5 | 939.2 | 18.10 | 159.200 | 107.94 |
| 255.9 | 1039.6 | 19.10 | 159.200 | 108.53 |

TABLE XVII

Elution of $U_3O_8$ From Column 4
Room Temperature - With Molybdenum

| Volume ML | BV | Effluent $U_3O_8$ Conc., Mg/liter | Cumm. $U_3O_8$ Mg |
|---|---|---|---|
| 1.0 | 0.39 | 0.165 | 0.165 |
| 0.75 | 0.69 | 1.140 | 1.02 |
| 1.0 | 1.10 | 31.490 | 32.51 |
| 2.0 | 1.90 | 34.020 | 100.55 |
| 5.0 | 3.80 | 13.210 | 166.58 |
| 10.6 | 8.00 | 6.370 | 234.08 |
| 19.6 | 15.70 | 2.180 | 276.72 |
| 28.8 | 27.00 | 0.896 | 302.53 |
| 93.0 | 63.40 | 0.276 | 328.19 |
| 5.6 | 65.60 | 0.012 | 328.26 |

The results are summarized in Table XVIII. As can be seen, heating the resin leads to a number of advantages when compared with ambient temperature operations. The uranium loading capacity is substantially increased by about 36% to about 48%. Furthermore uranium breakthrough during the loading phase is delayed by about 35% to 50% when compared to ambient temperature operations. This delay in uranium breakthrough results in a substantial reduction in the amount or volume of fluids requiring further treatment for uranium removal. Additionally, the heated resins will selectively recover uranium values from a lixiviant containing both uranium and molybdenum values.

TABLE XVIII

| | Run No. | | | | | | | |
|---|---|---|---|---|---|---|---|---|
| | 1 | 2 | 3 | 4 | 5 | 6 | 7 | 8 |
| Resin | Dowex | Dowex | IRA | IRA | Dowex | Dowex | IRA | IRA |
| $U_3O_8$ mg/l | 165 | 165 | 165 | 165 | 165 | 165 | 165 | 165 |
| Molybdenum Mg/l | 0 | 18.2 | 0 | 18.2 | 0 | 18.2 | 0 | 18.2 |
| Temp. °F. | 140 | 140 | 140 | 140 | 77 | 77 | 77 | 77 |
| % loading at uranium breakthrough | 78 | 80 | 71 | 81 | 58 | 53 | 60 | 60 |
| % Delay in uranium breakthrough | 34.58 | 50.9 | 18.3 | 35.0 | — | — | — | — |

TABLE XVIII-continued

| | Run No. | | | | | | | |
|---|---|---|---|---|---|---|---|---|
| | 1 | 2 | 3 | 4 | 5 | 6 | 7 | 8 |
| Loading Capacity lb/ft$^3$ | 11.0 | 10.8 | 10.3 | 10.9 | 8.1 | 7.9 | 7.0 | 7.4 |
| % increase in loading capacity | 35.80 | 36.71 | 47.14 | 47.30 | — | — | — | |

What is claimed is:

1. A method for the recovery of uranium values from a uranium-containing lixiviant, comprising the steps of:

(a) passing said lixiviant through an ion-exchange resin to cause said resin to retain uranium values, wherein the ion exchange resin is heated to a temperature sufficient to cause a substantial increase in uranium loading capacity as compared to ambient temperatures; and (b) recovering said uranium values from said ion-exchange resin.

2. The method of claim 1 wherein the ion-exchange resin is heated to a temperature not less than 110° F.

3. The method of claim 1 wherein the ion-exchange resin is heated to a temperature between 130° F. and 150° F.

4. The method of claim 1 wherein the lixiviant is heated to a temperature substantially the same as the ion-exchange resin prior to passing the lixiviant through the ion-exchange resin.

5. The method of claim 1 wherein the lixiviant contains carbonates, bicarbonates, or mixtures thereof.

6. The method of claim 1 wherein the recovery of the uranium values from the ion-exchange resin is achieved by eluting the uranium values from the ion exchange resin with an aqueous solution containing carbonate, bicarbonate, and chloride anions.

7. The method of claim 6 wherein the ion-exchange resin is heated during the recovery of uranium values from said resin.

8. A method for the recovery of uranium values from a lixiviant which contains uranium and molybdenum values, comprising the steps of:

(a) passing said lixiviant through a heated ion-exchange resin to cause said resin to selectively retain uranium values; and (b) recovering said uranium values from said ion-exchange resin.

9. The method of claim 8 wherein the ion-exchange resin is heated to a temperature not less than 110° F.

10. The method of claim 8 wherein the ion-exchange resin is heated to a temperature between 130° F. and 150° F.

11. The method of claim 8 wherein the lixiviant is heated to a temperature substantially the same as the ion-exchange resin prior to passing the lixiviant over the ion-exchange resin.

12. The method of claim 8 wherein the lixiviant contains carbonates, bicarbonates, or mixtures thereof.

13. The method of claim 8 wherein the recovery of the uranium values from the ion-exchange resin is achieved by eluting the uranium values from the ion exchange resin with an aqueous solution containing carbonate, bicarbonate, and chloride anions.

14. The method of claim 13 wherein the ion-exchange resin is heated during the recovery of uranium values from said resin.

15. A process for the recovery of uranium values from uranium-containing ore additionally containing molybdenum values, comprising the steps of:

(a) contacting the ore with an aqueous leaching solution to solubilize uranium and molybdenum values;

(b) passing the leachate through an anion-exchange resin wherein the resin is heated to a temperature sufficient to cause the resin to selectively retain uranium values and to cause a substantial increase in uranium loading capacity; and (c) recovering said uranium values from said anion exchange resin.

16. The method of claim 15 wherein the anion-exchange resin is heated to a temperature not less than 110° F.

17. The method of claim 15 wherein the anion-exchange resin is heated to temperature between 135° F. and 145° F.

18. The method of claim 15 wherein the leachate is heated to a temperature substantially the same as the anion-exchange resin prior to passing the leachate over the anion-exchange resin.

19. The method of claim 15 wherein the leaching solution contains carbonates, bicarbonates, or mixtures thereof.

20. The method of claim 15 wherein the recovery of the uranium values from the anion-exchange resin is achieved by eluting the uranium values from the anion exchange resin with an aqueous solution containing carbonate, bicarbonate, and chloride anions.

* * * * *

UNITED STATES PATENT AND TRADEMARK OFFICE

CERTIFICATE OF CORRECTION

PATENT NO. : 4,430,308

DATED : February 7, 1984

INVENTOR(S) : ARGELL FLETCHER

It is certified that error appears in the above-identified patent and that said Letters Patent is hereby corrected as shown below:

Column 8, Line 21: "118.3" should be --1188.3--

Signed and Sealed this

*Twenty-sixth* Day of *June 1984*

[SEAL]

*Attest:*

GERALD J. MOSSINGHOFF

*Attesting Officer*

*Commissioner of Patents and Trademarks*